United States Patent [19]

D'Andrade et al.

[11] 4,397,468

[45] Aug. 9, 1983

[54] SIMULATED TIN CAN TARGET GAME

[75] Inventors: Bruce M. D'Andrade, Whitehouse Station, N.J.; Johnny S. C. Yuen, Hong Kong, Hong Kong

[73] Assignee: Arco Industries Ltd., Hong Kong, Hong Kong

[21] Appl. No.: 373,424

[22] Filed: Apr. 30, 1982

[51] Int. Cl.[3] ..... F41J 1/00; F41J 5/00

[52] U.S. Cl. ..... 273/381; 273/387; 273/390

[58] Field of Search ..... 273/381, 382, 386, 387, 273/390, 391

[56] References Cited

U.S. PATENT DOCUMENTS

| | | | |
|---|---|---|---|
| 817,401 | 4/1906 | Stoltz | 273/379 |
| 1,008,874 | 11/1911 | Taylor | 273/381 |
| 1,749,689 | 3/1930 | Baum | 273/387 |
| 2,002,600 | 5/1935 | Bull | 273/387 |
| 2,113,521 | 8/1938 | Torres | 273/382 |
| 4,335,880 | 6/1982 | Meyer et al. | 273/310 |

*Primary Examiner*—Anton O. Oechsle
*Attorney, Agent, or Firm*—C. Hercus Just

[57] ABSTRACT

A target game adapted to be operated by darts from toy dart guns, thrown objects and the like, comprises a front panel arranged for vertical positioning, a row of simulated tin can targets are arrived along the upper edge of said panel and are supported upon depending arms pivotally supported rearwardly of the front panel, and score indicating panels are mounted on said arms in a manner to be positioned opposite one of a series of viewing openings in the front panel when a can target is hit by an object and toppled rearwardly and pivotally. Each arm adjacent the pivot therefor has a cam engageable with a corresponding projection on a horizontal rod rearwardly of the front panel to cause limited rotatary movement of the rod to actuate an elongated flexible member having a striker positioned to hit an audible signal member when the flexible member is flexed incident to the aforementioned movement of the rod.

4 Claims, 7 Drawing Figures

SIMULATED TIN CAN TARGET GAME

BACKGROUND OF THE INVENTION

For many years, actual tin cans have been used as targets, especially for target shooting with rifles and the like. Usually the tin cans are ranged along the top rail of a rail fence or the like and the shooter stands some distance therefrom and takes his turn among other shooters to see how many cans can be shot from the rail before he misses and the next shooter takes a turn to shoot at the cans.

Shooting firearms has become a sport restricted to rural areas and such restrictions seem to be continually tightened so that the sport is diminishing.

Target sport of a similar type also has been popular for many years at fairs, amusement parts and the like by providing standing objects of different kinds at which baseballs and other types of projectiles are thrown in an effort to knock them over and hopefully receive a prize of some kind. Amusement of the foregoing type also has been reduced to the field of toys and games, particularly for purposes of associating with the target shooting member a score indicating means for purposes of rendering the game of a competitive nature by a number of contestants, and typical examples of games and amusement devices are found in the following patents.

U.S. Pat. No. 817,401, to Stoltz, patented Apr. 10, 1906, pertains to an amusement device in the form of a figure mounted on the upper end of a pivoted bar and when the figure is hit with a projectile, the bar and target move by gravity against the complex apparatus for purposes of releasing a ball or simulated egg-actuating gate means and causing the same to run into a trough.

Another U.S. Pat. No. 1,749,689, to Baum, dated Mar. 4, 1930, illustrates a toy target having a plurality of circular target members that can be struck by a suitable projectile and then pivotally dislodged from its perch at the top of a board and upon falling rearwardly, the target member causes a scoring member on a depending tail to be placed in viewing position adjacent to an opening in the supporting board while the target member actually falls behind.

Another prior U.S. Pat. No. 2,002,600, to Bull, dated May 28, 1935, shows a number of target members having angularly disposed score indicating panels connected thereto and, when the target member is knocked from a vertical position, the scoring member is brought into viewing position.

As an example of a target device capable of sounding an audible alarm or indicator, prior U.S. Pat. No. 2,113,521, to Torres, dated Apr. 5, 1938, discloses a pivoted target member seen upwardly through a sloping surface in a sort of hood-like manner, and when struck by a ball or the like, the target member actuates a certain type of clapper in a bell to cause an audible sound.

The present invention pertains to an amusement device attempting to capture some of the glamour of the old tin can target type of amusement in a manner which is different from the above-described patented structure, details of which are set forth below.

SUMMARY OF THE INVENTION

It is among the principal objects of the present invention to provide a toy-like shooting gallery stand which includes a vertical front panel along the upper edge of which a plurality of simulated toy cans are posed in a row and transversely spaced from each other, these preferably being of different sizes and susceptible to being decorated to resemble actual labeled tin can, the can targets being supported by arms extending downwardly therefrom, posed relative to the opposite side of said front panel, the panel also having a score viewing opening arranged therein respectively below each simulated tin can target, said arms being pivotally supported relative to the front panel. Attached thereto are score-indicating members so arranged that when a can target is struck such as from a toy dart gun, or other form of projectile, it literally moves rearward and downward in such manner as to dispose the score value of the score indicating member opposite the viewing opening therefor in the front panel.

It is another object of the present invention to provide with each arm of the simulated cans a cam member adjacent the pivoted support for said arms for purposes of actuating the audible signal member, preferably in the form of a bell which is hit by a striker supported upon an elongated flexible member extending downward from a horizontal rod upon which a plurality of projections extend so as to have a portion thereof adjacent said cams upon said arms of the can targets, the arrangement being such that when a can target is hit and topples rearwardly, the cam on the arm of said target member moves the projection associated with it on the aforementioned rod in a manner to flex the elongated flexible member in a manner to energize the same to cause the member to move the striker thereon against the bell until the cam has moved past and disengaged the projection it has just actuated upon said rod.

It is a further object of the invention to provide an abutment rearwardly of the front panel and adjacent the audible means and to be engaged by the elongated flexible member and thereby energized as aforesaid due to the coaction of the cam on the arm of the target member with the projection on the rod which also supports the elongated flexible member, whereby when the cam and projection have disengaged, the stored energy in the flexible member moves the striker thereon into contact with the audible means such as a bell, thereby combining with the score-indicating means of the game an interesting and amusing additional feature of an audible sound highly appealing to children.

Details of the foregoing objects and of the invention, as well as other objects thereof, are set forth in the following specification and illustrated in the drawing comprising a part thereof.

DETAILED DESCRIPTION OF THE PREFERRED EMBODIMENT OF THE INVENTION

Figure 1:
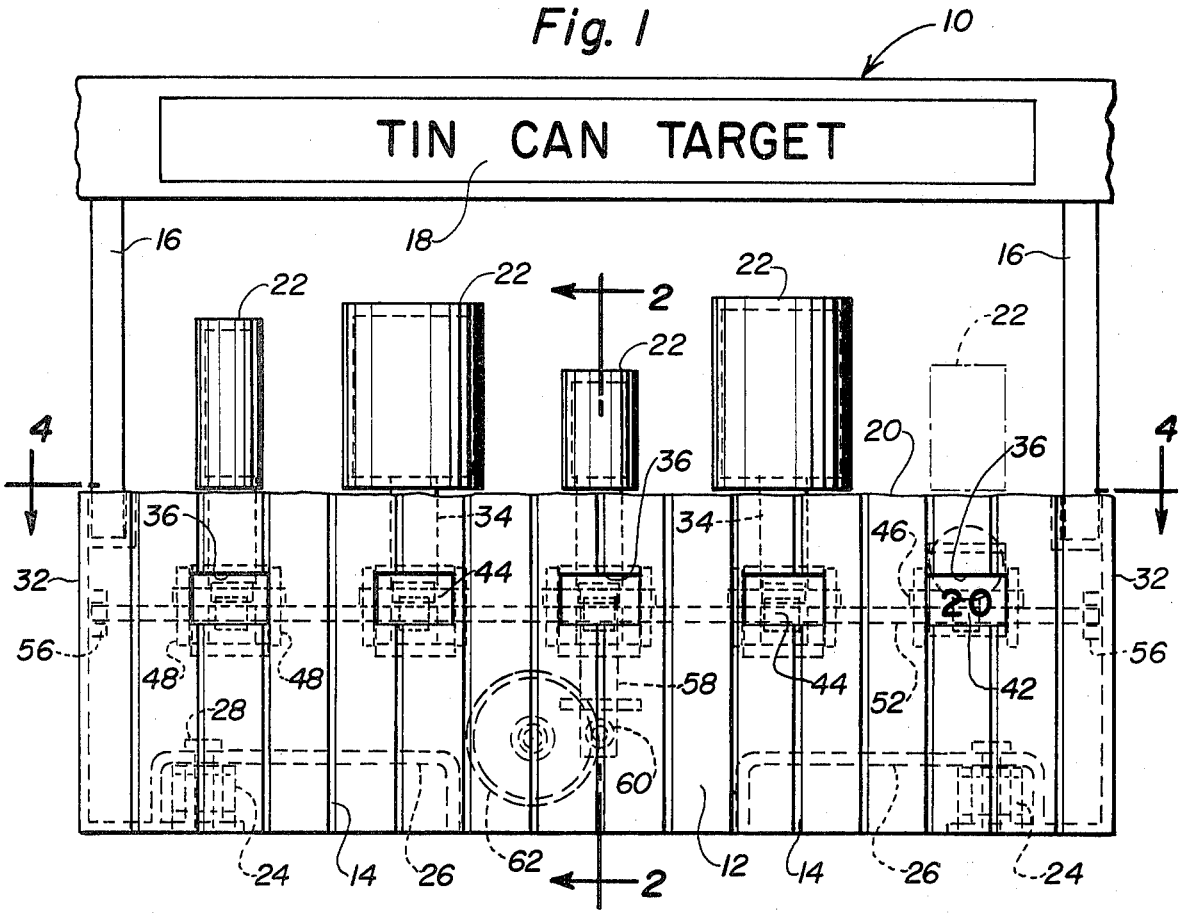
FIG. 1 is a front elevation of a target game encompassing the principles of the present invention and showing in full lines a number of simulated tin cans and, in phantom, showing the position previously occupied by one of the target cans which has been hit by a projectile and toppled from the line of target cans to cause a score-indicating panel to be visible in one of the openings in the front panel of the game.

Referring particularly to FIG. 1, it will be seen that the game or toy of the present invention comprises a simulated shooting gallery stand 10, which for example may be made from any suitable material such as wood, plastic, metal, or otherwise. It has been found that for purposes of present day manufacturing operations, the stand lends itself very well to being molded from suitable rigid plastic material to form, for example, a front panel 12. For example, the front surface may have grooves 14 molded therein to resemble simulated boards between the grooves. Upright members 16 extend upwardly from the upper edge of the front panel 12 to support an appropriate sign board 18 at the upper ends thereof. Also, the upper edge 20 of front panel 12, as viewed in FIG. 1, somewhat simulates the upper edge of a fence upon which the simulated toy tin cans 22, of various sizes, are displayed. The simulated tin cans 22 also preferably may be readily manufactured by molding from plastic material, for example, and if desired, may contain simulated labels of various kinds to render the toy characteristic of its intended simulation of tin can targets.

Figure 3:
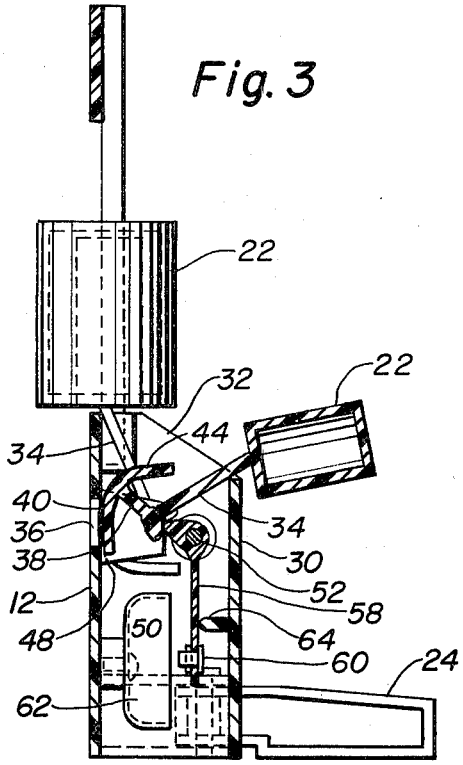
FIG. 3 is a vertical sectional view similar of FIG. 2 but illustrating the position of target can in FIG. 2 in toppled position to cause the score indicating member to be placed opposite the viewing opening as shown in FIG. 1.
Figure 4:
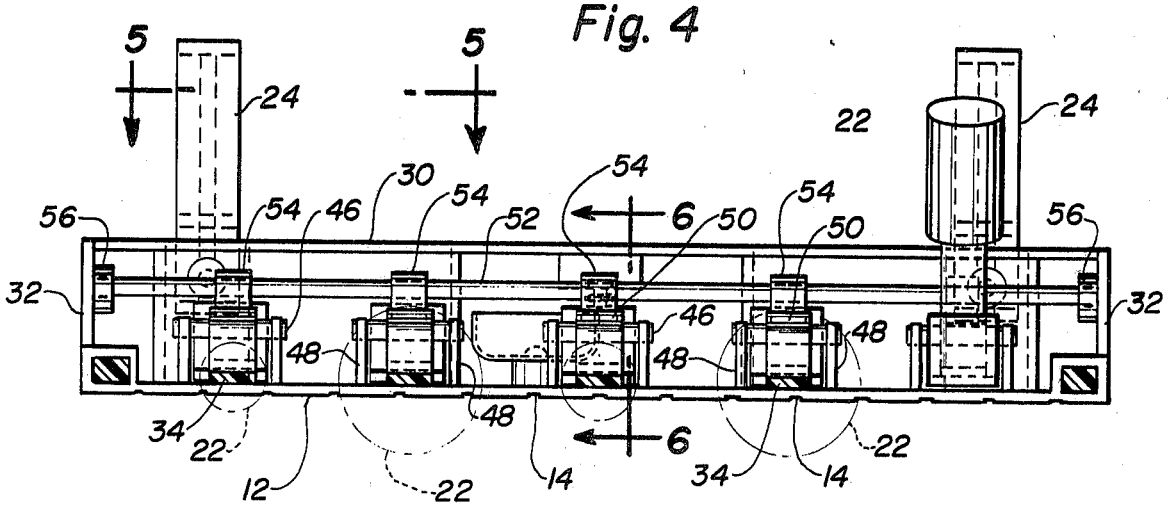
FIG. 4 is a horizontal sectional view of the target game shown in FIG. 1 as seen on the line 4—4 thereof.
Figure 5:
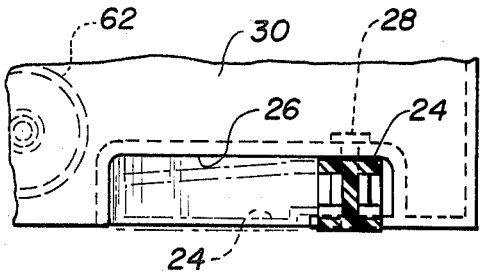
FIG. 5 is a fragmentary elevational view of the area indicated by the line 5—5 of FIG. 4 and showing one of the support legs of the front panel upright in section and also illustrating an alcove molded into a rear panel to receive the pivotally mounted support legs shown in phantom.

The front panel and the members extending upward therefrom preferably are disposed in a vertical position in use and this readily is accomplished, for example, by providing the front panel with a pair of rearwardly extending, horizontal support legs 24, shown in plan view in FIG. 4 for example. Also, a rear panel 30 is provided at the lower edge thereof, in longitudinally spaced manner, molded cavities 26, shown fragmentarily, for example, in FIG. 5, in which the legs 24 are shown in vertical section and, in phantom, are shown in folded condition for purposes of ready storage of the toy or game within a sales carton or the like. A suitable pivot pin 28 secures the legs 24 to the walls of the cavities 26 for pivotal movement toward and from operative, extended position as shown in FIG. 4. Further, referring to FIGS. 2, 3, 6*a*, and 6*b*, it will be seen that there is provided rearwardly from the front panel 12 a shorter, upstanding panel 30 which is parallel to the front panel 12 and coextensive therewith at the lower edges, the ends of the panels 12 and 30 respectively being connected by narrow end panels 32 which serve certain additional functions set forth below and, for example, the molded cavity 26 may extend inwardly from the rearward, upstanding panel 30.

Figure 2:
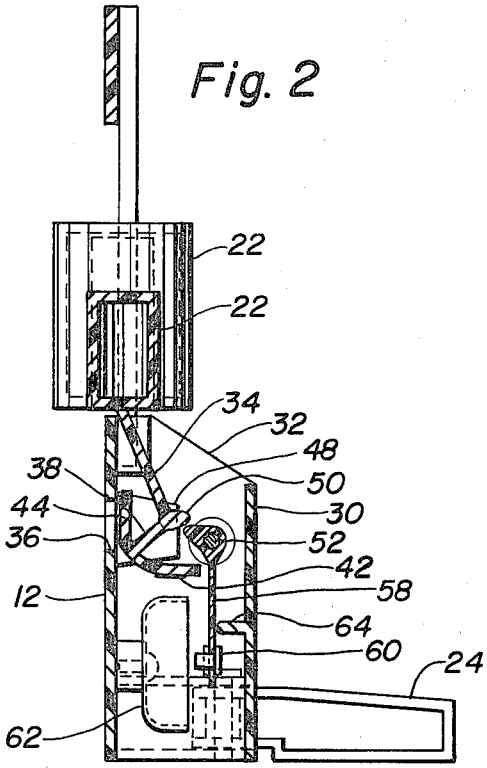
FIG. 2 is a vertical sectional view taken on 2—2 of FIG. 1.

The toy tin cans 22 preferably are molded so as to be hollow and although illustrated with bottom panels in certain of the figures, it is to be understood that the bottoms may be open but in any event, connected to each of the simulated tin cans 22 is an arm 34 and, for example, extending downwardly from the axis of the tin cans at an angle as best shown in FIGS. 2 and 3 for purposes preferably of positioning the forward portions of the simulated tin cans 22 outwardly beyond the outer face of the front panel 12 as shown in said Figures. The front panel 12 also is provided, in alignment below each one of the simulated tin cans, with a viewing opening 36, best shown in FIG. 1 but also illustrated in side elevation in FIGS. 2 and 3. Connected to the lower end of each of the arms 34 is a strut 38 which extends angularly therefrom and is connected at its outer end to a somewhat L-shaped score indicating member 40, upon which score indicia 42 are printed or otherwise formed as shown for example near the right hand end of FIG. 1. It will be seen that the score indicia 42 is formed only on one "leg" of the members 40 in such manner that when one of the simulated tin cans 22 is toppled from the initial vertical position, to the toppled position shown for example in FIG. 3 in cross section, the score indicia 42 on the indicating member 40 connected to said tin can is disposed in viewing position as shown in FIG. 1, within the viewing opening 36 associated with that particular tin can. The other "leg" 44 is only for purposes of closing the opening 36 when the tin can connected thereto is in the upright position.

Figure 6A:
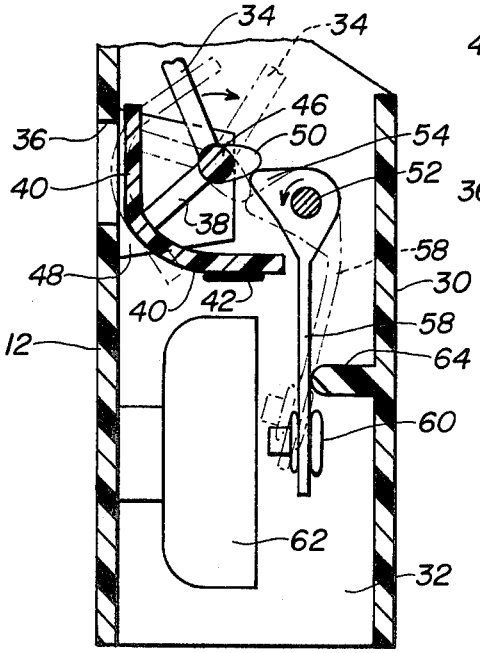
FIGS. 6*a* and 6*b* respectively are enlarged vertical sectional views taken on the line 6—6, FIG. 4 and illustrating details of the cam-actuation of the elongated flexible arm which supports a striker which hits a bell when the flexible arm is energized by the cam actuation in conjunction with a projection rearward of the bell and adapted to be engaged by said flexible member, the latter figure showing the striker in contact with the bell.
Figure 6B:
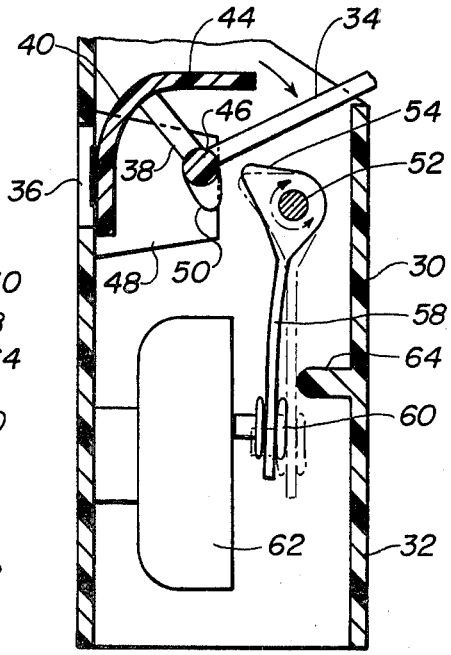

One very convenient and appropriate means for playing the game or toy is to use a toy dart gun, of which many are available on the market at present. The darts are shot at the tin cans 22 and when one is hit by a dart or other type of projectile, that tin can is toppled to the position shown in FIG. 3 and, in order to enhance the appeal of the game to those playing it, not only is a score indicated for purposes of promoting competition between a number of players, but a realistic additional feature is included in the form of an audible signal, such as very frequently provided in actual shooting galleries employing live ammunition and the like. The details of the aubible means are as follows:

The arm 34 of each of the simulated tin cans 22 are pivotally supported by means of transverse pins 46 which are relatively short and project from opposite side edges of said arms, these pins being shown in cross section especially in FIGS. 6*a* and 6*b* but also being illustrated in FIG. 4 in top plan view. They may be integrally molded at the time of forming the arms 34 and the end portions thereof respectively are supported in pairs of rearwardly extending supporting ears 48 as clearly shown especially in FIG. 4. Any suitable pivotal connection between the ears 48 and the ends of the transverse pins 46 may be employed such as by flexing the ears apart to dispose ends of the pins in sockets, not shown, or any other appropriate type of snap-acting means for example, as long as the arms 34 are readily pivotable relative to the ears 48. Also formed on each of the transverse pins 46 is a cam 50, best shown in FIGS. 6*a* and 6*b* but also shown in FIGS. 2 and 3. Said cams have rounded ends for ease of action. Extending longitudinally between the end panels 32 is a shaft 52 on which a series of projections 54 are fixed, the shaft 52 is rotatably supported in bearings 56 in end panels 32 as shown in FIG. 4. One of said projections 54, as shown in side view in FIGS. 6*a* and 6*b* is characteristic of the others and also shows the rounded ends thereof for coaxion with the cams 50. Especially as shown in FIG. 6*a*, when the tin cans 22 are vertical, cams 50 and projections 54 co-engage to maintain the cans 22 in vertical position.

Mentioned above, one of the projections 54, such as the central one in FIG. 4, is provided with a depending elongated flexible member 58, molded for example from suitable plastic material and supporting on the lower end thereof a suitable striker 60 which is engageable with a bell 62 comprising the audible sound member referred to above. Actuation thereof is as follows.

Extending inwardly from the upstanding panel 30 is a projection 64 against which the flexible member 58 is disposed when the cans 22 are in upstanding normal position, as shown in FIG. *6a*. When one of the cans is hit by any suitable means so as to topple it to the position shown in FIG. 3 in cross section, such movement causes cam 50 to engage one of the projections 54 associated therewith and this causes the shaft 52 to move all of the projections, including the one attached to the flexible member 58. Such engagement causes flexing of the member 58 in the manner shown, in phantom, in FIG. *6a* whereby, after the cam 50 has disengaged the projection 64, the flexing force produced in the member 50 causes the same to strike bell 62 with the striker 60 and emit a desirable sound coincident with the score indicia 42 which is disposed opposite the opening 36.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A simulated tin can target game comprising in combination a panel structure resembling the front of a shooting target gallery and having a front panel arranged to be positioned vertically by support members, a row of simulated target cans spaced apart transversely in a row adjacent the upper edge of said front panel, an arm extending downward from each simulated target can below the upper edge of said front panel, transverse pins on said arms supported pivotally relative to said front panel, a score indicating panel connected to the lower end of each of said arms and disposed at an angle thereto, score-viewing openings in said front panel respectively aligned with each target can below the upper edge of said front panel, said score-indicating panels being positioned relative to said arms in such manner that when a target can is struck by a shot or thrown object it will pivotally move rearward and downward and cause the score-indicating panel of said target can to be disposed for viewing the score indication thereof through the viewing opening aligned with said target can, an audible signal member supported rearwardly of said front panel, a striker on an elongated flexible member depending from a support pivot on the rear side of said front panel and provided with a projection on the upper end of said member, and a cam member on the arm of at least one target can operable to engage said projection on said flexible member when a target can is moved rearward from a hit to flex said flexible member in a manner to energize it to cause the striker thereon to hit the audible member as the cam member moves past said projection and disengages it, thereby to supplement the showing of the score value displayed in one of said openings aligned with the target can that has been hit by a projectile.

2. The target game according to claim 1 further including an abutment positioned rearwardly of said flexible member and arranged to be engaged in the same manner when moved as aforesaid by said cam action and thereby effect flexing of said member to energize it as aforesaid to move the striker against said audible signal member.

3. The target game according to claim 2 further including an elongated rod extending along said front panel, rearward thereof and parallel thereto, a plurality of said projections respectively fixed to said rod in alignment with said cams on said arm of each target can, whereby there is only a single elongated flexible member and single audible signal member to be struck by the striker on said member, whereby when any of said can targets is hit and pivotally moved rearward and downward the cam on the arm thereof will actuate the projection on said shaft aligned therewith and thereby effect movement of said shaft and elongated flexible member thereon to flex it as aforesaid to sound said audible signal member.

4. The target game according to claim 3 further characterized by pairs of spaced parallel supporting ears being fixed to the rear side of said front panel and extend rearwardly therefrom in alignment with said transverse panel on each of said arms and having bearings therein pivotally receiving opposite end portions of said pins to support said arms and target cans thereon pivotally relative to said front panel, and said cam members on said arms respectively engaging said projections on said rod when said target cans are in upright position to maintain the same in said position until struck and moved rearwardly.

* * * * *